US006743081B2

(12) United States Patent
Chen

(10) Patent No.: US 6,743,081 B2
(45) Date of Patent: Jun. 1, 2004

(54) IN-LINE OSCILLATING DEVICE

(75) Inventor: Chih-Kun Chen, Taoyuan Hsien (TW)

(73) Assignee: Nanya Technology Corporation, Taoyuan (TW)

( * ) Notice: Subject to any disclaimer, the term of this patent is extended or adjusted under 35 U.S.C. 154(b) by 220 days.

(21) Appl. No.: 10/034,328

(22) Filed: Dec. 28, 2001

(65) Prior Publication Data

US 2003/0100253 A1 May 29, 2003

(30) Foreign Application Priority Data

Nov. 27, 2001 (TW) ..... 90129243 A

(51) Int. Cl.[7] ..... B24B 1/00
(52) U.S. Cl. ..... 451/60; 451/446; 451/910
(58) Field of Search ..... 451/36, 38, 39, 451/40, 41, 60, 285, 287, 910, 446

(56) References Cited

U.S. PATENT DOCUMENTS 5,674,115 A * 10/1997 Yamashita et al. ..... 451/289
5,895,583 A * 4/1999 Augustine et al. ..... 216/53
6,155,275 A * 12/2000 Shinbara ..... 134/61
6,341,997 B1 * 1/2002 Lin ..... 451/39
6,604,849 B2 * 8/2003 Lin et al. ..... 366/154.2

* cited by examiner

*Primary Examiner*—Eileen P. Morgan
(74) *Attorney, Agent, or Firm*—J.C. Patents

(57) ABSTRACT

An in-line oscillating device is essentially composed of an oscillating tank, an oscillating pipe, and an oscillating generator. The oscillating pipe is set in the oscillating tank and connects with a slurry pipe. The oscillating generator for generating ultrasonic waves is mounted on the oscillating tank. Furthermore, the oscillating tank is filled with a medium to transmit the ultrasonic waves generated by the oscillating generator to the oscillating pipe. The in-line oscillating device is suitable to be mounted on any location of the slurry pipe where oscillation is needed.

16 Claims, 7 Drawing Sheets

IN-LINE OSCILLATING DEVICE

CROSS-REFERENCE TO RELATED APPLICATION

This application claims the priority benefit of Taiwan application serial no. 90129243, filed Nov. 27, 2001.

BACKGROUND OF THE INVENTION

1. Field of the Invention

The invention relates in general to a chemical mechanical polishing (CMP) machine. More particularly, the invention relates to an in-line oscillating device mounted on a slurry pipe in a CMP machine.

2. Description of the Related Art

As far as semiconductor processing technology is concerned, surface planarization is an important technology for processing high-density photolithography. A precise pattern transfer is achieved from a plane surface with no drop or no protrusion for avoiding exposure scattering. The planarization technology roughly comprises a spin-on glass (SOG) process and a CMP process. However, after the semiconductor processing technology enters the sub-micron stage, the SOG process does not satisfy the planarization for the sub-micron stage. As a result, the CMP process becomes rarely a global planarization technology for very-large scale integration (VLSI) or ultra-large scale integration (ULSI). In the CMP process, a reagent of slurry is sprayed on a polishing pad and for reacting to an active surface of a wafer, causing the active surface to form an easy-polishing layer. Thereafter, the protrusion area of the easy-polishing layer of the wafer positioned on the polishing pad is polished. Repeating the above chemical reaction and mechanical polishing can form a planar surface. Basically, the CMP process is a planarization technology in which a mechanical polishing principle is applied with an adaptable reagent and abrasive particles.

Referring to FIG. 1, it is a schematic view illustrating how slurry is transmitted to a CMP machine using a slurry pipe according to prior art. A CMP machine 110 essentially comprises a polishing platform 114, a polishing pad 112 positioned on the polishing platform 114, a holder for grasping a polished body, and a slurry pipe 101 for supplying slurry. The slurry pipe 101 are composed of a main pipe 100, a transmitting pipe 102, a backflow pipe 104, a filter 106, and a peristalsis pump 108. When the CMP process is performed, the peristalsis pump 108 transmits the slurry from the main pipe 100 to the transmitting pipe 102. Through the filter 106, the particles whose size are unfit are filtered out from the slurry being transmitted to the transmitting pipe 102. Thereafter, the slurry is transmitted to the polishing pad 112. When the CMP process is not performed, the slurry in the transmitting pipe 102 flows back into the main pipe 100 through the backflow pipe 104. However, the slurry particles can deposit or stick at a corner of the pipe or at the connecting area between the, backflow pipe 104 and the transmitting pipe 102.

In the conventional slurry pipe, the slurry particles can deposit or stick at a corner of the pipe or at the connecting area between the pipes. The deposited chunks of slurry particles are so large that a wafer can be scratched thereby during the CMP process.

SUMMARY OF THE INVENTION

Accordingly, it is an objective according to the present invention to provide an in-line oscillating device. The in-line oscillating device can oscillate the slurry particles in the slurry pipe so that it is difficult for the slurry particles to deposit and stick on the pipe walls. Therefore, the wafer will not be scratched.

To achieve the foregoing and other objects, the present invention provides an in-line oscillating device essentially composed of an oscillating tank, an oscillating pipe, and an oscillating generator. The oscillating pipe is equipped in the oscillating tank and connects with a slurry pipe. The oscillating pipe is constructed from, for example, a snake-like pipe and two connecting pipes. The both ends of the snake-like pipe connect with the slurry pipe respectively through the connecting pipes. The oscillating generator for generating ultrasonic waves is mounted on the oscillating tank. Moreover, the oscillating tank is filled with a medium, such as deionized water, for transmitting the ultrasonic waves generated by the oscillating generator to the oscillating pipe.

The oscillating tank of the present invention is provided with a medium inlet for injecting the medium into the oscillating tank and a medium outlet for discharging the medium from the oscillating tank.

The design of the connecting pipes of the present invention can be determined by the slurry pipe. For instance, the connecting pipes can be a beeline type, a branch type or other types.

The oscillating generator of the present invention is composed of a controller and at least one oscillator. The controller can control the oscillator to generate ultrasonic waves, The in-line oscillating device of the present invention can be mounted on any location of the slurry pipe where oscillation is needed. A variety of connecting pipes can connect the in-line oscillating device and the slurry pipe.

Both the foregoing general description and the following detailed description are exemplary and explanatory only and are not restrictive of the invention, as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. A simple description of the drawings is as follows.

DESCRIPTION OF THE PREFERRED EMBODIMENTS

Figure 1:
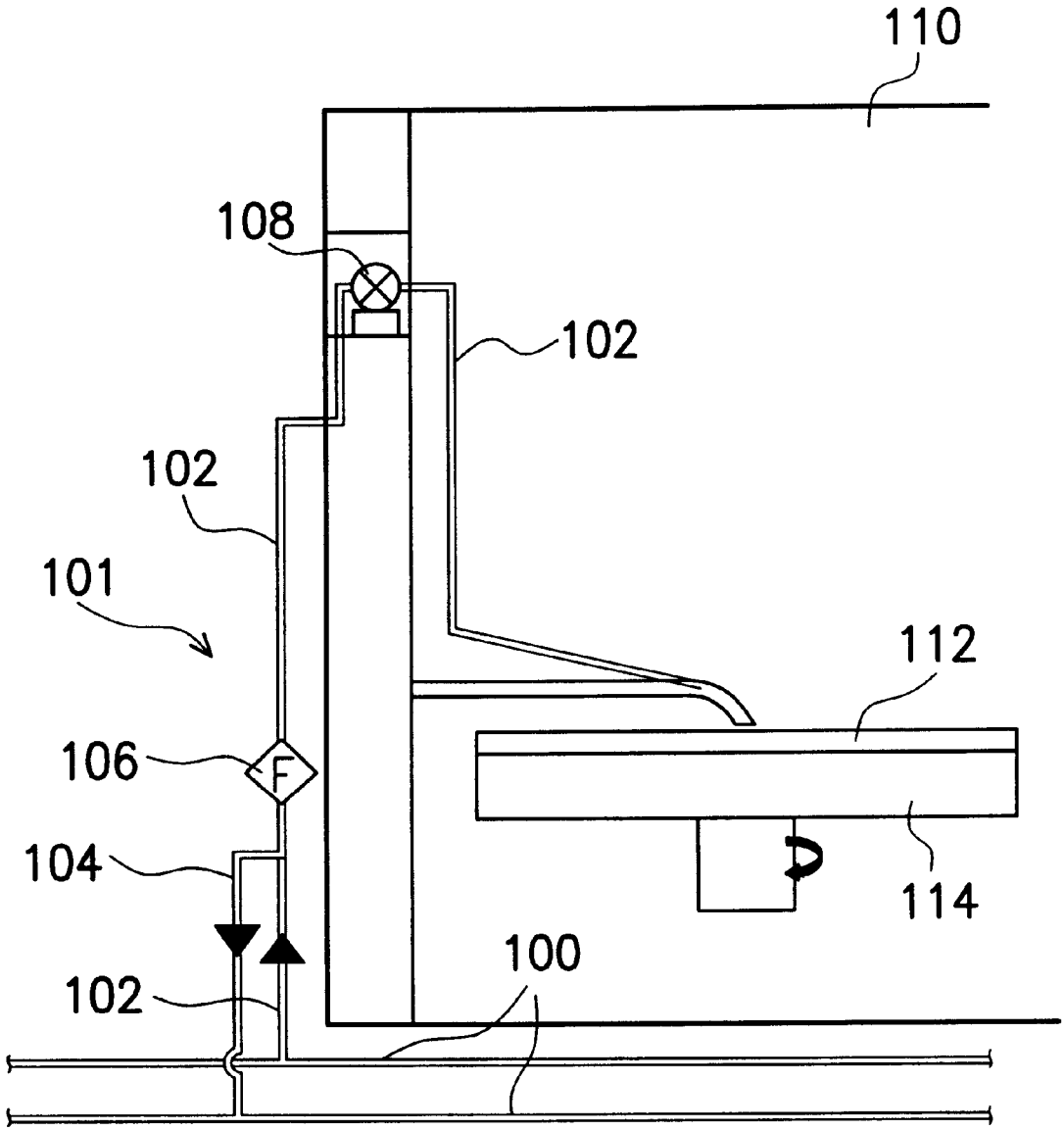
FIG. 1 (PRIOR ART)
FIG. 1 is a schematic view illustrating that slurry is transmitted to a CMP machine using a slurry pipe according to prior art.
Figure 2:
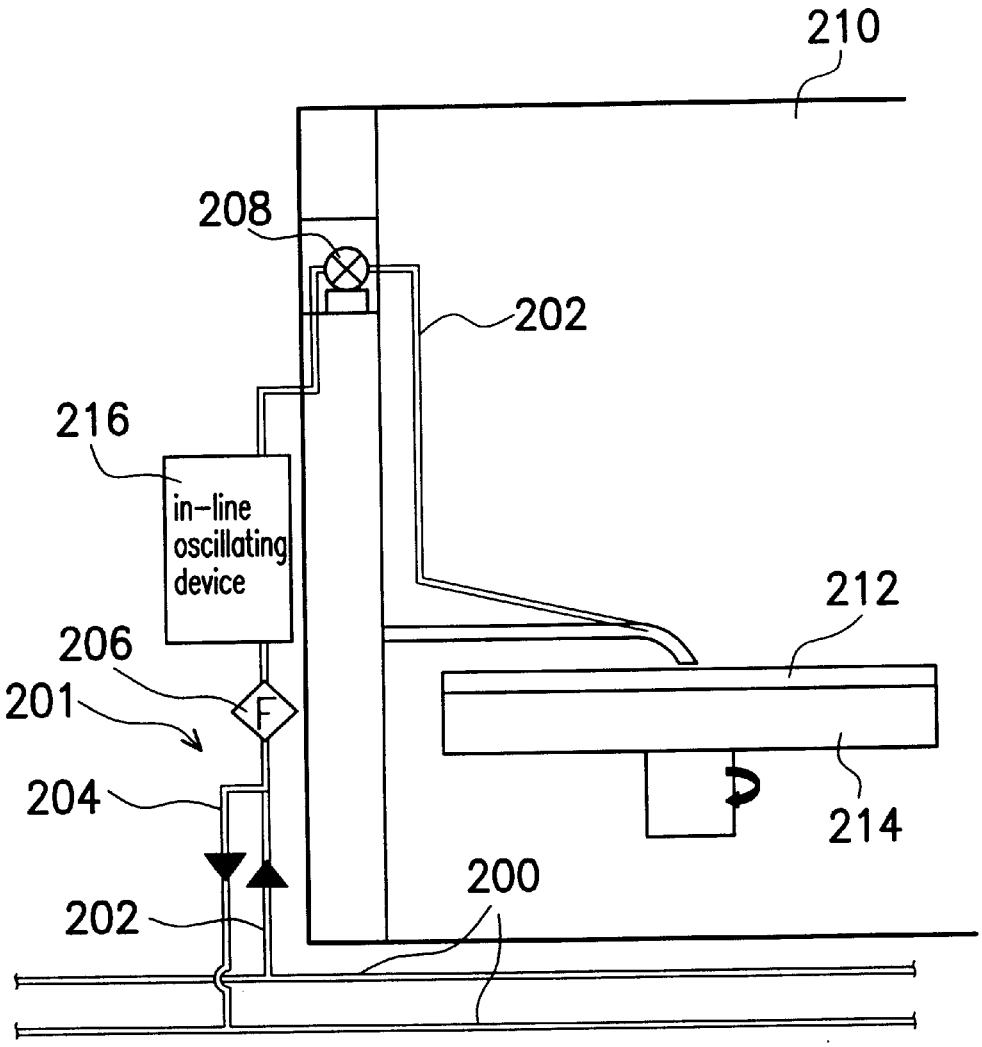
FIG. 2 is a schematic view illustrating that an in-line oscillating device is mounted upstream before a peristalsis pump according to a preferred embodiment of the present invention.
Figure 3:
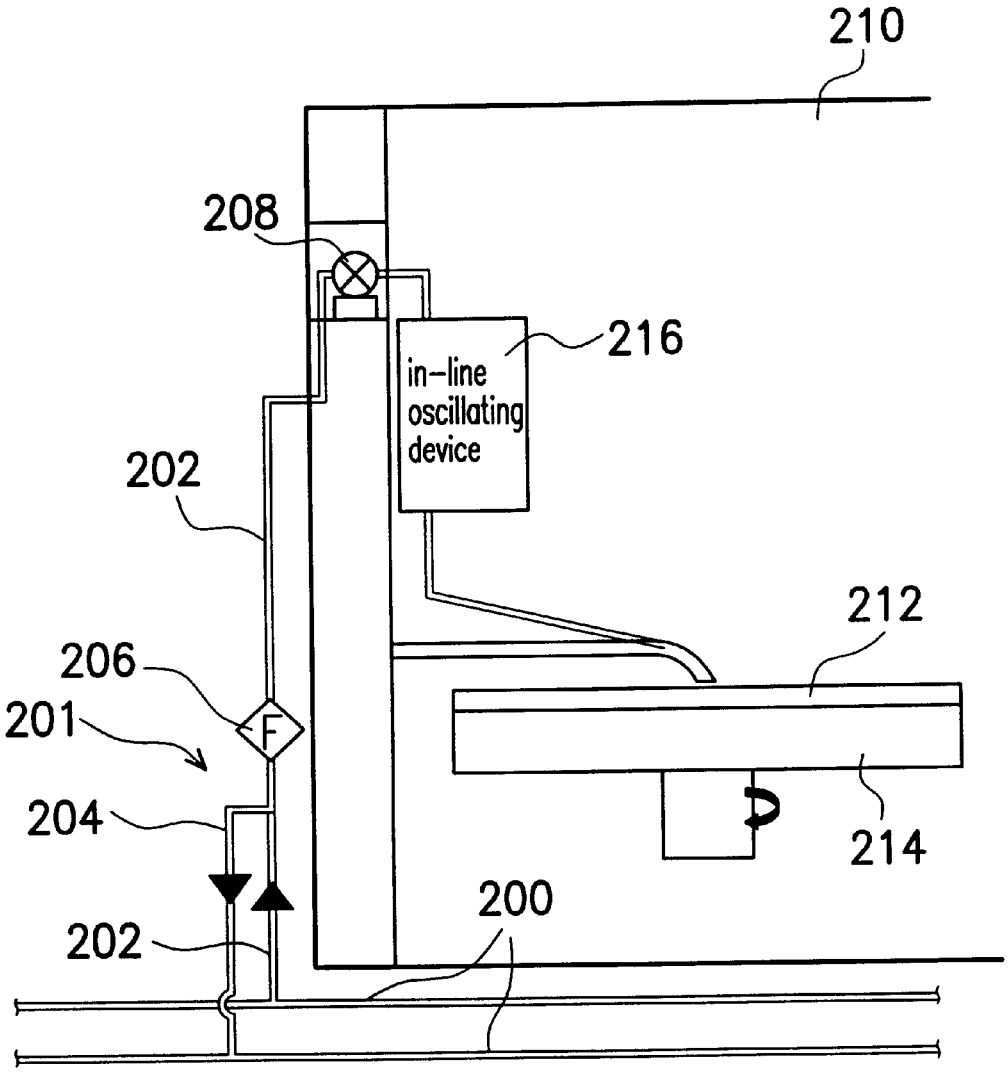
FIG. 3 is a schematic view illustrating that an in-line oscillating device is mounted downstream after a peristalsis pump according to a preferred embodiment of the present invention.

FIG. 2 shows a schematic view illustrating that an in-line oscillating device is mounted upstream before a peristalsis pump according to a preferred embodiment of the present invention. FIG. 3 shows a schematic view illustrating that an in-line oscillating device is mounted downstream after a peristalsis pump according to a preferred embodiment of the present invention. As shown in FIG. 2 and FIG. 3, a CMP machine 210 essentially comprises a polishing platform 214, a polishing pad 212 positioned on the polishing platform 214, a holder for grasping a polished body, and a slurry pipe 201 for supplying slurry. The slurry pipe 101 are composed, for instance, of a main pipe 200, a transmitting pipe 202, a backflow pipe 204, a filter 206, a peristalsis pump 208, and an in-line oscillating device 216. The in-line oscillating device 216 can generate, for example, ultrasonic waves in which the slurry being transmitted to the in-line oscillating device 216 can be oscillated.

When a CMP process is performed, the peristalsis pump 208 transmits the slurry from the main pipe 200 to the transmitting pipe 202. Through the filter 206, the particles whose size are unfit are filtered out from the slurry being transmitted to the transmitting pipe 102. Thereafter, the slurry is oscillated by the in-line oscillating device 216. Finally, the oscillated slurry is transmitted to the polishing pad 212 for performing a CMP process. The in-line oscillating device 216 can be mounted anywhere on the slurry pipe 201 between the filter 206 and the peristalsis pump 208, or on the slurry pipe 201 downstream after the peristalsis pump 208. The in-line oscillating device 216 can oscillate the slurry transmitted through the slurry pipe 201 such that it is difficult for the slurry particles to deposit and stick on the pipe walls.

Figure 4:
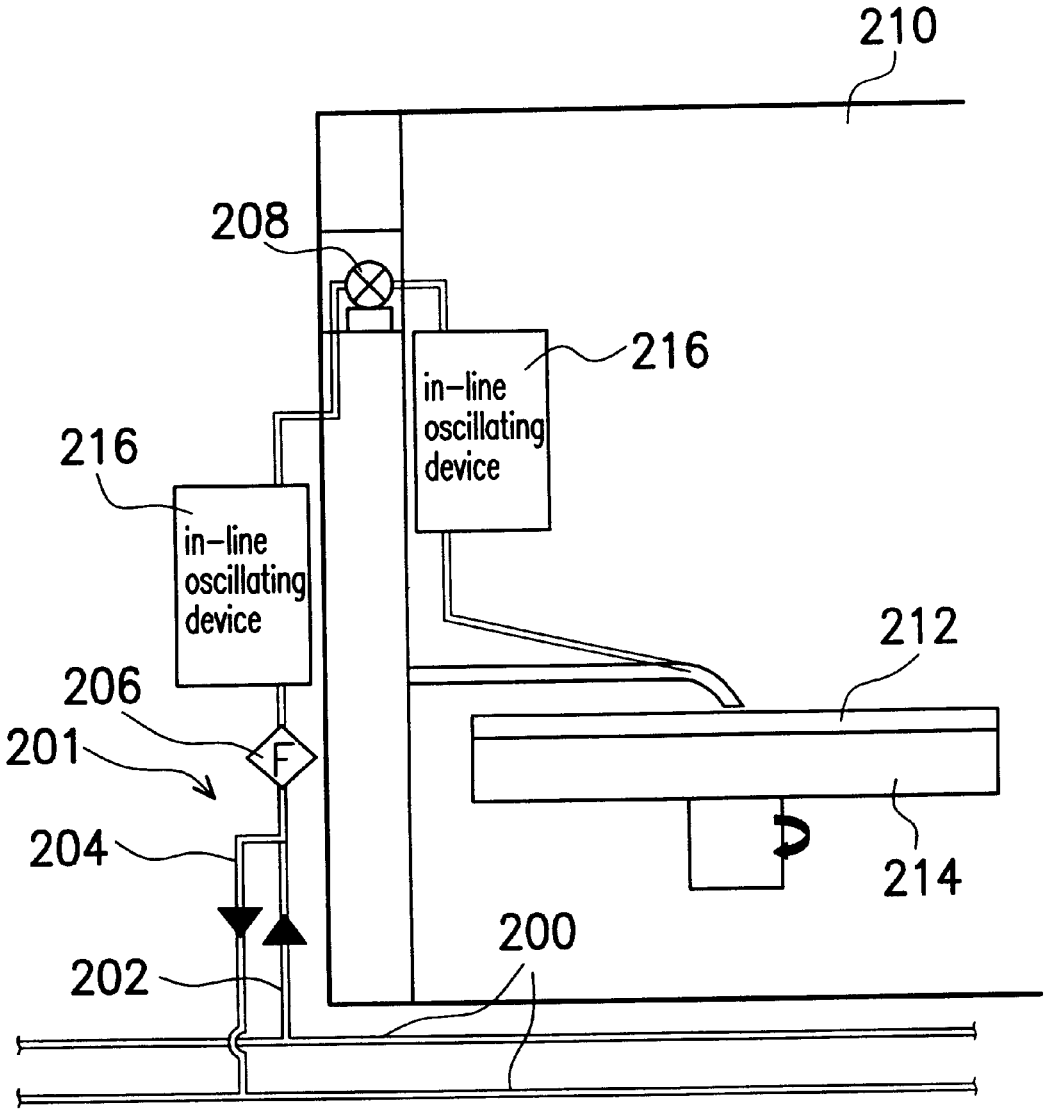
FIG. 4 is a schematic view illustrating that in-line oscillating devices are mounted respectively upstream before and downstream after a peristalsis pump according to a preferred embodiment of the present invention.

FIG. 4 shows a schematic view illustrating that the in-line oscillating devices are respectively mounted upstream before and downstream after a peristalsis pump according to a preferred embodiment of the present invention. As shown in FIG. 4, in order to further improve the problem of the slurry particles being deposited and stuck on the pipe walls, one or more in-line oscillating devices 216 can be mounted respectively upstream before and downstream after the peristalsis pump 208. By mounting many in-line oscillating devices 216 on the slurry pipe 201, the slurry in the slurry pipe 201 can be frequently oscillated before transmitted to the CMP machine 210. Therefore, it is even more difficult that the slurry particles can deposit and stick on the pipe walls.

Figure 5:
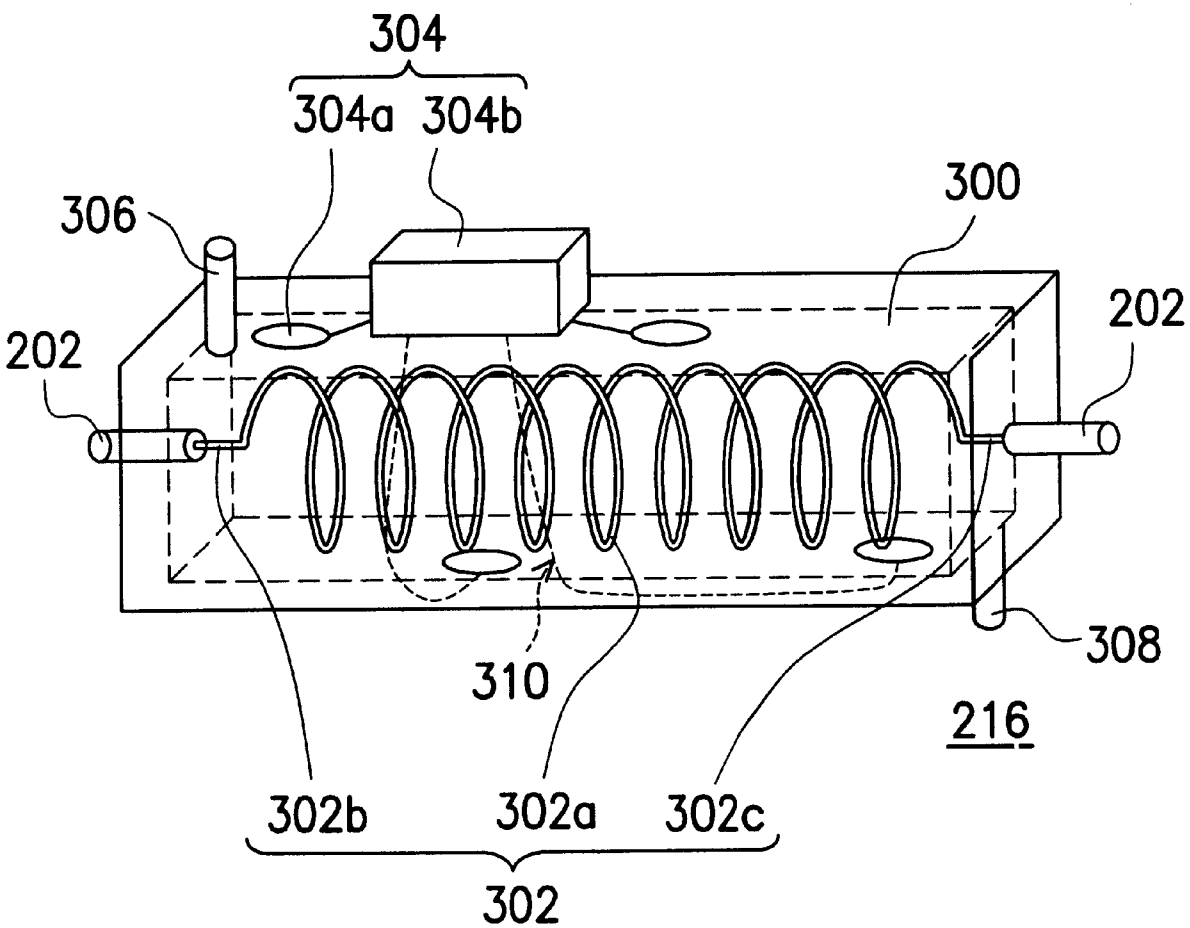
FIG. 5 is a schematic view of an in-line oscillating device according to a preferred embodiment of the present invention.

FIG. 5 shows a schematic view of an in-line oscillating device according to a preferred embodiment of the present invention. The in-line oscillating device 216 as illustrated in FIG. 2, FIG. 3, and FIG. 4 essentially comprise an oscillating tank 300, an oscillating pipe 302, and an oscillating generator 304. The oscillating tank 300 is filled with a medium, such as deionized water, in order for transmitting the ultrasonic waves generated by the oscillating generator 304 that is mounted on the oscillating tank 300. The oscillating pipe 302 is placed in the oscillating tank 300 and connects with the transmitting pipe 202 for conveying slurry. Besides, The oscillating tank 300 is provided with a medium inlet 306 for injecting the medium into the oscillating tank 300 and a medium outlet 308 for discharging the medium from the oscillating tank 300.

As shown in FIG. 5, the medium injected into the oscillating tank 300 is for transmitting the ultrasonic waves generated by the oscillating generator 304 to the oscillating pipe 302. The oscillating pipe 302 is constructed from, for example, a snake-like pipe 302*a* and two connecting pipes 302*b*, 302*c*. The both ends of the snake-like pipe 302*a* connect with the transmitting pipe 202 respectively through the connecting pipes 302*b*, 302*c*. The connecting pipes 302*b*, 302*c* are beeline type. The snake-like pipe 302*a* is like a spring shape, but it can also be replaced with another pipe with a different shape that is preferred to increase the oscillating time of slurry in the oscillating pipe 302. The snake-like pipe 302*a* can be a hose or a bellow pipe.

The oscillating generator 304 is constructed of a controller 304*b* and at least one oscillator 304*a*. The controller 304*b* can control the oscillator 304*a* to generate ultrasonic waves. The ultrasonic waves 310 are transmitted pipe 20 oscillating pipe 302 through the medium in the oscillating tank 300 and oscillate the slurry in the snake-like pipe 302*a* and connecting pipes 302*b*, 302*c*.

Figure 6:
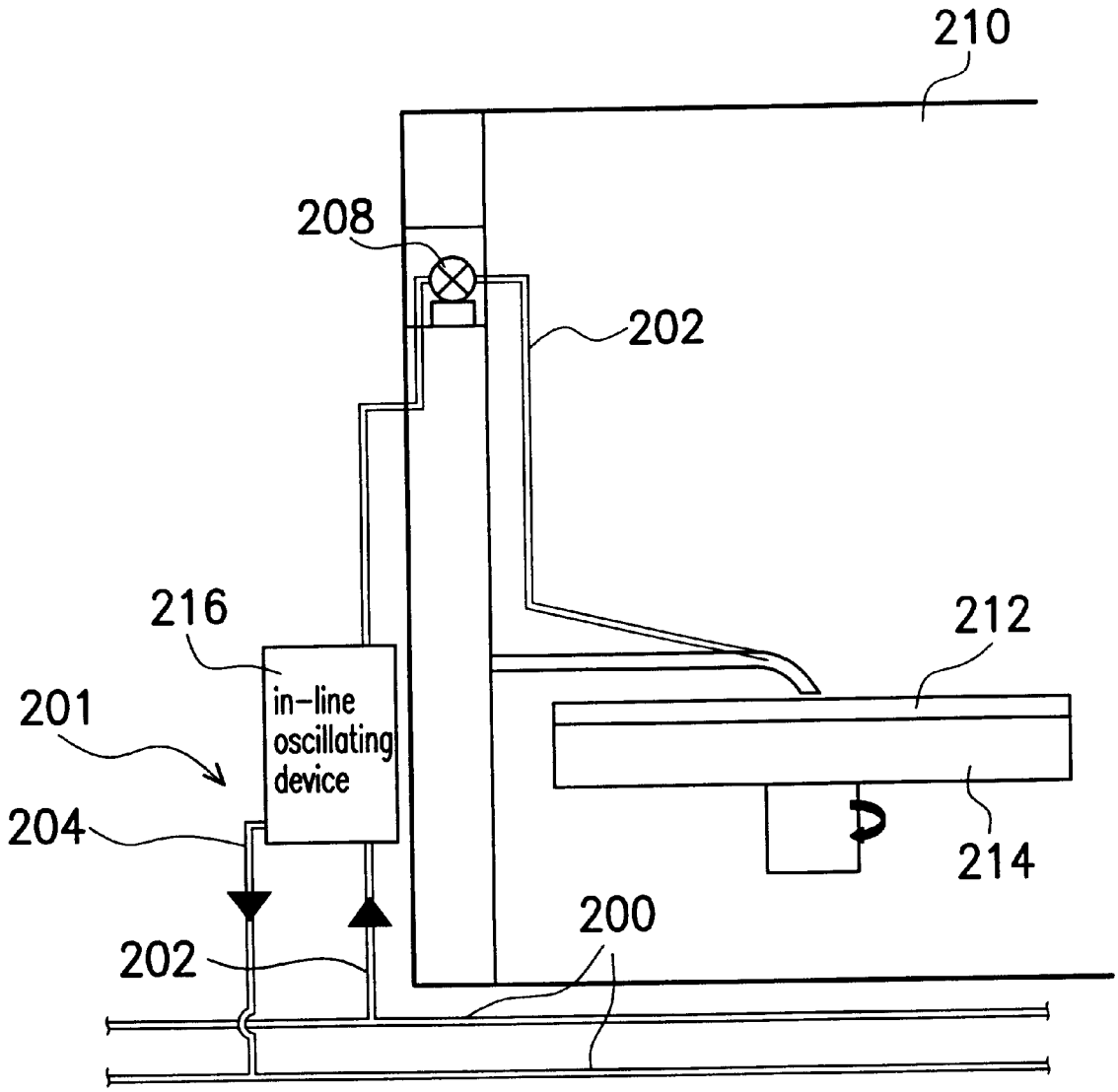
FIG. 6 is a schematic view illustrating that an in-line oscillating devices is mounted to oscillate the connecting area between a transmitting pipe and a backflow pipe according to a preferred embodiment of the present invention.

FIG. 6 shows a schematic view illustrating that the in-line oscillating devices are mounted to oscillate the connecting area between the transmitting pipe and the backflow pipe according to a preferred embodiment of the present invention. When the CMP process is not performed, the slurry in the transmitting pipe 202 flows back into the main pipe 200 through the backflow pipe 204. However, the slurry particles can deposit or stick at the connecting area between the backflow pipe 204 and the transmitting pipe 202. The in-line oscillating device 216 further oscillates the connecting area between the transmitting pipe 202 and the backflow pipe 204 to prevent the slurry particles from being deposited or stuck at the connecting area between the backflow pipe 204 and the transmitting pipe 202.

Figure 7:
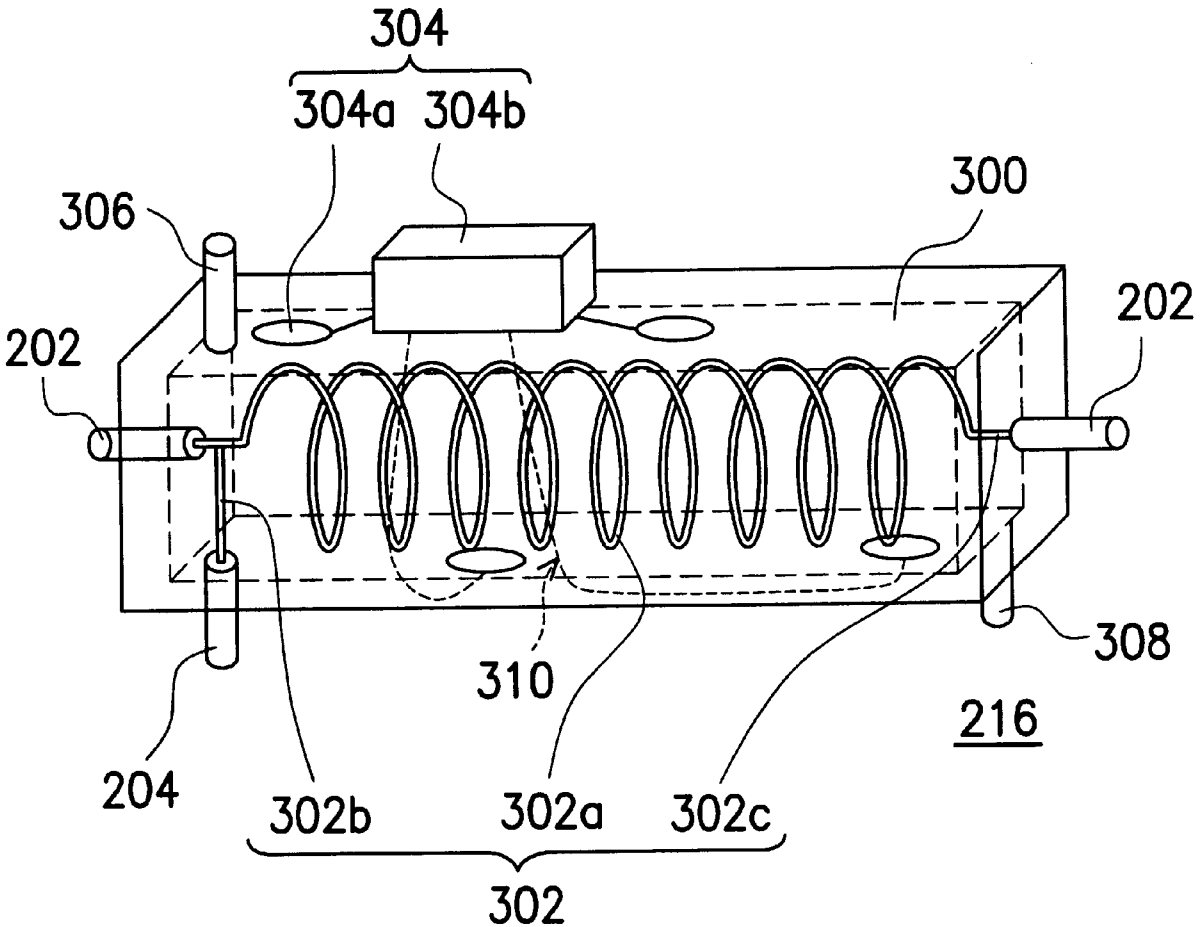
FIG. 7 is a schematic view of an in-line oscillating device oscillating the connecting area between a transmitting pipe and a backflow pipe according to a preferred embodiment of the present invention.

FIG. 7 shows a schematic view of an in-line oscillating device oscillating the connecting area between a transmitting pipe and a backflow pipe according to a preferred embodiment of the present invention. The medium injected into the oscillating tank 300 is transmitting the ultrasonic waves generated by the oscillating generator 304 to the oscillating pipe 302. The oscillating pipe 302 is constructed from, for example, a snake-like pipe 302*a* and two connecting pipes 302*b*, 302*c*. The both ends of the snake-like pipe 302*a* are connected with the transmitting pipe 202 respectively through the connecting pipes 302*b*, 302*c*. The connecting pipe 302*c* is a beeline type. The connecting pipe 302*b* is a branch type, such as a T-type, a Y-type or other types. The connecting pipe 302*b* of a branch type can connect the transmitting pipe 202, the backflow pipe 204, and the snake-like pipe 302*a* together. All of the connecting areas, which are between the connecting pipe 302*b* and the transmitting pipe 202, between the connecting pipe 302*b* and the backflow pipe 204, and between the connecting pipe 302*b* and the snake-like pipe 302*a*, are in the oscillating tank 300. Therefore, the problem of the slurry particles being deposited or stuck at the connecting areas can be improved.

In the above-mentioned embodiment, the connecting pipe 302*b* of a beeline type or a branch type is illustrated, but the type of the connecting pipe 302*b* is not limited to that described. The design of the connecting pipe 302*b* of the present invention can be determined by the slurry pipe 201.

A variety of connecting pipe 302*b* can be used to connect the snake-like pipe 302*a* and the slurry pipe 201. The snake-like pipe 302*a* also can be replaced with another pipe with a different shape that is preferred to increase the oscillating time of slurry in the oscillating pipe 302.

To sum up, the in-line oscillating device of the present invention has the following advantages:

1. The in-line oscillating device of the present invention can oscillate slurry particles in a slurry pipe so that it is difficult for the particles to deposit and stick on a pipe wall so the particles will not deposit and form relatively large chunks of particles.
2. The in-line oscillating device of the present invention can oscillate slurry particles in a slurry pipe to prevent a wafer from being scratched because the relatively large chunks of particles will not be deposited or stuck.
3. The in-line oscillating device of the present invention is provided with a snake-like pipe for increasing the oscillating time of slurry in the oscillating pipe, causing the distribution of slurry particles to be relatively uniform.
4. The in-line oscillating device of the present invention can be provided with connecting pipes of various types, such as a beeline type or a branch type. As a result, the mounting the in-line oscillating device on a slurry pipe is flexible.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An in-line oscillating device connected with a slurry pipe by which a liquid with particles is transmitted, comprising:

an oscillating tank;

an oscillating pipe located in the oscillating tank and connected with the slurry pipe so that the liquid with particles passes through the oscillating pipe; and an oscillating generator mounted on the oscillating tank, wherein the oscillating generator is adapted to oscillate the particles passing through the oscillating pipe.

2. The in-line oscillating device according to claim 1, wherein the oscillating tank is filled with a medium.

3. The in-line oscillating device according to claim 2, wherein the medium is comprises deionized water.

4. The in-line oscillating device according to claim 1, wherein the oscillating tank is provided with a medium inlet and a medium outlet.

5. The in-line oscillating device according to claim 1, wherein the oscillating pipe comprises:

a snake-like pipe; and two connecting pipes connecting the snake-like pipe and the slurry pipe.

6. The in-line oscillating device according to claim 5, wherein the connecting pipes are a beeline type or a branch type.

7. The in-line oscillating device according to claim 1, wherein the oscillating generator comprises:

at least one oscillator mounted on the oscillating tank; and a controller mounted on the oscillating tank for controlling the oscillator.

8. The in-line oscillating device according to claim 1, wherein the oscillating generator generates ultrasonic waves.

9. A slurry pipe system suitable for supplying slurry to a chemical mechanical polishing (CMP) machine, comprising:

a slurry pipe suitable for transmitting the slurry to the CMP machine; and an in-line oscillating device comprising an oscillating tank, an oscillating second pipe, and an oscillating generator, the oscillating pipe located in the oscillating tank and connected with the slurry pipe and the oscillating generator mounted on the oscillating tank.

10. The slurry pipe system according to claim 9, wherein the oscillating tank is filled with a medium.

11. The slurry pipe system according to claim 10, wherein the medium is comprises deionized water.

12. The slurry pipe system according to claim 9, wherein the in-line oscillating tank is provided with a medium inlet and a medium outlet that-ore mounted in the oscillating tank.

13. The slurry pipe system according to claim 9, wherein the oscillating pipe comprises:

a snake-like pipe; and two connecting pipes connecting the snake-like pipe and the slurry pipe.

14. The slurry pipe system according to claim 13, wherein the connecting pipes are a beeline type or a branch type.

15. The slurry pipe system according to claim 9, wherein the oscillating generator comprises:

at least one oscillator mounted on the oscillating tank; and a controller mounted on the oscillating tank for controlling the oscillator.

16. The slurry pipe system according to claim 9, wherein the oscillating generator generates ultrasonic waves.

* * * * *